US010994812B2

(12) United States Patent
Colmard et al.

(10) Patent No.: US 10,994,812 B2
(45) Date of Patent: May 4, 2021

(54) DEVICE FOR COUPLING TWO BOATS

(71) Applicant: SAIPEM S.A., Montigny le Bretonneux (FR)

(72) Inventors: Christophe Colmard, Guyancourt (FR); Sylvie Deschamps, Paris (FR); Mathieu Buschiazzo, Magny les Hameaux (FR)

(73) Assignee: SAIPEM S.A., Montigny le (FR)

( * ) Notice: Subject to any disclaimer, the term of this patent is extended or adjusted under 35 U.S.C. 154(b) by 0 days.

(21) Appl. No.: 16/488,769

(22) PCT Filed: Feb. 9, 2018

(86) PCT No.: PCT/FR2018/050325

§ 371 (c)(1),
(2) Date: Aug. 26, 2019

(87) PCT Pub. No.: WO2018/154212

PCT Pub. Date: Aug. 30, 2018

(65) Prior Publication Data

US 2019/0382083 A1 Dec. 19, 2019

(30) Foreign Application Priority Data

Feb. 27, 2017 (FR) ..... 1751558

(51) Int. Cl.
*B63B 35/44* (2006.01)
*E02B 3/00* (2006.01)
(Continued)

(52) U.S. Cl.
CPC ..... *B63B 21/50* (2013.01); *B63B 21/00* (2013.01); *B63B 21/02* (2013.01); *B63B 27/25* (2013.01);
(Continued)

(58) Field of Classification Search
CPC ... B63B 21/00; B63B 2021/006; B63B 21/02; B63B 21/50; B63B 27/25; B63C 1/06; F25J 1/0278
(Continued)

(56) References Cited

U.S. PATENT DOCUMENTS 3,257,985 A * 6/1966 Glosten ..... B63B 35/70 114/250
3,746,060 A 7/1973 Janssen et al.
(Continued)

FOREIGN PATENT DOCUMENTS

EP 1705112 A1 9/2006
WO 2008015971 A1 2/2008
(Continued)

OTHER PUBLICATIONS

French Search Report from FR Application No. 1751558, dated Nov. 1, 2017.
(Continued)

*Primary Examiner* — Daniel V Venne
(74) *Attorney, Agent, or Firm* — Workman Nydegger

(57) ABSTRACT

A device for rapidly remotely coupling together two vessels, in particular a first ship or floating support and a second ship, comprises: at least one floating and docking structure fastened to or suitable for being releasably fastened to the side and/or the keel of the hull of a second vessel; and at least two actuators spaced in succession from one another in the longitudinal direction of the first vessel. The actuator cylinder of each the actuator is arranged to be fastened to the side of the hull of the first vessel, using a first fastener and pivot hinge device. The end of the rod of each actuator is arranged to be fastened to or suitable for being fastened to the floating and docking structure via a second fastener and pivot hinge device.

17 Claims, 8 Drawing Sheets

(51) Int. Cl.

| | |
|---|---|
| ***B63B 21/50*** | (2006.01) |
| ***B63B 21/00*** | (2006.01) |
| ***B63B 21/02*** | (2006.01) |
| ***B63B 27/25*** | (2006.01) |
| ***B63C 1/06*** | (2006.01) |
| *F25J 1/02* | (2006.01) |

(52) U.S. Cl.
CPC ..... *B63C 1/06* (2013.01); *B63B 2021/006* (2013.01); *F25J 1/0278* (2013.01); *F25J 2290/60* (2013.01)

(58) Field of Classification Search
USPC ..... 114/230.1, 230.15, 230.16, 230.17, 114/230.18, 230.19, 263–267

See application file for complete search history.

(56) References Cited

U.S. PATENT DOCUMENTS

| | | | | |
|---|---|---|---|---|
| 3,841,501 | A | 10/1974 | Heijst | |
| 7,182,660 | B2 * | 2/2007 | De Baan | B63B 22/023 114/230.1 |
| 7,299,835 | B2 * | 11/2007 | Dupont | B63B 1/125 114/230.23 |

FOREIGN PATENT DOCUMENTS

| | | | |
|---|---|---|---|
| WO | 2009041833 | A1 | 4/2009 |
| WO | 2009054739 | A1 | 4/2009 |
| WO | 2014073973 | A1 | 5/2014 |

OTHER PUBLICATIONS

International Search Report from PCT Application No. PCT/FR2018/050325, dated Apr. 24, 2018.

* cited by examiner

DEVICE FOR COUPLING TWO BOATS

BACKGROUND

The present invention relates to a device for docking together two vessels at sea and referred to herein as a "coupling device". This docking device serves to keep the two vessels spaced apart laterally from each other at a controlled distance, typically about thirty meters, while conserving their side-by-side longitudinal position, in particular in order to perform transshipment between the two vessels.

The term "vessel" is used herein to designate both a transport ship and also a floating support moored with the sea bed, such as a floating production storage and offloading (FPSO) unit, a floating liquefied natural gas (FLNG) unit for producing, storing, and offloading liquefied natural gas, or a floating storage and regasification unit (FSRU).

This type of device is particularly adapted to enable a first ship or floating support of the type comprising a floating installation for liquefying or regassifying natural gas (FLNG) to be offloaded to a second ship such as a methane tanker or "LNG carrier" via flexible or rigid pipes.

The difficulty encountered is the limit of environments that are acceptable during the offloading, in particular swell, wind, and/or sea current conditions that often make such transshipment operations difficult between two vessels at sea without running the risk of collision between the ships.

SUMMARY

The object of the present invention is thus to increase the safety of offloading operations between two vessels by controlling and stabilizing the spacing between the two vessels; in particular to make offloading operations between a floating installation of the FLNG or the FSRU type and a ship of the LNG carrier type more safe, specifically in order:

- to prevent stopping production in floating installations of the FLNG type when they are subjected to rough weather conditions but still need to offload their production in order to continue working; and
- to enable floating installations of the FLNG type to be developed in zones where weather conditions do not make this possible using standard systems because of the impossibility of offloading.

Traditional systems for docking or mooring are known that make use of cylinders/fenders that do not make it possible to control the spacing between the two vessels dynamically and that cannot handle potential large differences in vertical movements between the two vessels, requiring the two ships to be positioned one against that other, which is not acceptable at sea in the event of bad swell conditions.

Conversely, systems that are safe and fast are known for docking or mooring a ship against a quay, in particular systems using air suction cups or magnetic suction cups as developed by the supplier Cavotec and as described in particular in WO 2009/041833 and WO 2009/054739. However, those systems do not handle the problem of forces between the vessels that can become very large in bad weather if the vessels are in contact with each other, and they do not enable a controlled minimum spacing to be set up between the two ships.

Finally, WO 2014/073973 discloses a system that enables spacing to be maintained between two vessels, the system comprising a coupling device comprising (FIG. 3) a ballasted caisson 2 that is movable from a first floating support (1) to which it is moored by mooring lines 24 so as to be pressed against and under a second ship (3). The positioning of the caisson 2 against the second ship 3 is performed by tensioning the mooring lines 24 that are anchored to the sea bottom and driven using a winch 23. That system takes a long time to put into place and presents a lack of flexibility that makes it necessary to maintain a large amount of spacing, at least 100 meters (m), between the vessels when the vessels are 100 m to 300 m long.

More precisely, the object of the present invention is to provide a mechanical device that is simpler and quicker to deploy and that makes it possible to conserve the parallel longitudinal position of the two vessels side by side while keeping them spaced apart laterally at a controlled variable distance of a few tens of meters, and in particular lying in the range 25 m to 50 m.

To do this, the present invention provides a device for remotely coupling together two vessels, in particular a first vessel consisting of a first ship or floating support and a second vessel consisting of a second ship, the device comprising:

- at least one floating and docking structure comprising at least one float suitable for being ballasted and deballasted in order to enable said floating and docking structure to be immersed in controlled manner, and at least one docking element fastened to or suitable for being releasably fastened to the hull of a second vessel; and
- at least two actuators, preferably at least three actuators, spaced in succession from one another in the longitudinal direction of the first vessel, one end of the actuator cylinder of each said actuator being fastened to said first vessel, preferably to the side of the hull of said first vessel, using a first fastener and pivot hinge device, and the end of the rod of each actuator being fastened to or being suitable for being fastened, preferably in releasable manner, to a said floating and docking structure via a second fastener and pivot hinge device.

The device of the invention is an accessory or an auxiliary device of the first vessel that becomes fastened temporarily to the second vessel and that does not require auxiliary means for assisting in docking such as tugs, hoist means, or hawsers.

The device is suitable for being put into place more particularly on the side of an FLNG and it can be controlled hydraulically in order to be fastened to the hull of another vessel, typically a methane tanker (LNG carrier), or in non-limiting manner to two vessels that need to perform a transshipment.

The device of the present invention makes it possible to control and stabilize the spacing between the two vessels at a mean distance while also making it possible:

- to take up a portion of the mean forces of the swell, the wind, and the current as transmitted between the two vessels, and also
- to allow the two vessels to move in independent manner depending on environmental stresses and to conserve in part their six degrees of freedom of movement (sway—surge—heave—roll—pitching—yaw) like a simple mooring system.

Once the device is attached to the second vessel, it is capable of keeping the spacing between the two vessels at a constant mean distance either passively or by appropriate hydraulic control of the actuators under sea conditions that may typically extend to significant amounts of swell up to 4 m, the swell coming mainly from the front at 0° or from a quarter at 45°, without seeking to prevent the roll, pitching, or yaw movements of the vessels.

Said float is suitable a) for providing said floating and docking structure with buoyancy and keeping said actuators out of the water prior to attaching the second vessel, and b) for allowing said float to be immersed more deeply by ballasting when attaching said attachment elements of said floating and docking structure to the second vessel.

Because of the sliding stroke of the actuators, and because of their pivot hinge connections with the two vessels, it is possible for the two vessels to interact dynamically with each other relatively little because the forces taken up by the device are forces that are averaged and not impact forces. Thus, it is possible to keep the two vessels together at a spacing that is limited but variable, e.g. over the range 25 m to 50 m, even when the swell becomes strong, with a swell of about 4 m typically being acceptable.

More particularly, said actuators in the retracted position and fastened to said floating and docking structure via said second fastener and hinge devices are suitable for being positioned together, preferably vertically or in a position close to the vertical, against the hull of the first vessel, and out of the water when said floating and docking structure is not fastened to a said second vessel and said docking float is de-ballasted.

The device of the invention can thus be stowed safely in this way, in particular during a storm or between two transshipments, with the actuators in the retraced position and fastened to said floating and docking structure, the assembly being suitable for being positioned against the hull of the first vessel while simultaneously retracting the actuators and de-ballasting said float, given the rotary pivoting made possible by said first and second fastener and pivot hinge devices.

The actuators when retracted and fastened to said floating and docking structure with said docking float de-ballasted can be held stationary against the hull of the first vessel using a conventional system for holding the assembly stationary, e.g. by tightening straps.

More particularly, said first and second fastener and pivot hinge devices at the end of each actuator each make possible at least a first pivoting movement of said actuator about a horizontal first axis perpendicular to the longitudinal axis of said actuator, and a second pivoting movement of said actuator about a second axis perpendicular to the longitudinal axis of said actuator and situated in a vertical plane containing the longitudinal axis of said actuator.

Thus, overall, the two fastener and hinge devices at the two ends of each actuator in combination make it possible for each actuator to have two degrees of freedom to move in pivoting, comprising:

a) a first pivoting movement of said actuator about a horizontal first pivot axis that allows relative movements between the two vessels in the vertical direction and that also allows the actuators to be stowed by being pivoted against and/or above the side of the first vessel while remaining fastened to said floating and docking structure; and b) a second pivoting movement of said actuator about a second pivot axis in a vertical plane allowing relative movements between the two vessels in the longitudinal direction of one of the two vessels.

In addition, the differential longitudinal sliding of the various actuators enables the two vessels to move angularly relative to each other.

Preferably said first and second fastener and pivot hinge devices at the ends of each actuator also make possible a third pivoting movement about the longitudinal direction of the actuator.

Still more particularly, when the rod of each said actuator is fastened to a said floating and docking structure, said actuator is arranged above the surface of the sea horizontally or with the actuator rod sloping relative to a horizontal plane at an angle of less than 15 degrees while remaining out of the water, the cylinders of said actuators preferably being fastened to the side of the hull of said first vessel at the same height.

Positioning the actuators out of the water makes it possible to limit the impacts of swell and current on the actuators and thereby avoid interfering forces on the actuators due to the sea, and finally to avoid the effects of corrosion.

Still more particularly, when said actuators are fastened to a said floating and docking structure, they are arranged parallel to one another and/or sloping at an angle of less than 30°, preferably less than 15°, relative to a vertical plane perpendicular to the vertical plane that is tangential to the side of the first vessel.

Positioning the various actuators horizontally at the same height also makes it possible to avoid interfering forces on the actuators.

Still more particularly, said actuators are double-acting hydraulic actuators having rods that are set to an initial coupling extension position, preferably at half-stroke, and having a hydraulic circuit that is adjusted and/or automatically controlled in such a manner that any departure from said initial coupling extension position is corrected in order to reestablish the desired spacing between the two vessels, and in particular to reestablish the initial extension of the actuator rods.

It is possible to use the device of the invention in a passive mode or in a controlled mode, in particular under software control, and in either mode, the hydraulic circuits of the actuators act as springs for maintaining as well as possible the spacing between the vessels and for limiting forces as a function of the stiffnesses of the actuators, insofar as the initial extension position of each actuator is maintained by a pressure difference against the two faces of their pistons.

The response of the actuators may be linear, i.e. a response that is independent of the extension position of the rod, or the response may be non-linear, i.e. a response in which the more the vessels move apart or towards each other the greater the force within an actuator becomes.

More particularly, for said first and second ship or floating support having a length of 100 m to 300 m, and in order to maintain spacing between the first vessel and the second vessel in the range 15 m to 50 m, actuators are used that have a length in the range 10 m to 30 m with a stroke in the range 5 m to 20 m. Still more particularly, for said first and second ship or floating support having a length of 150 m to 300 m, and in order to maintain spacing between the first vessel and the second vessel in the range 25 m to 40 m, preferably spacing in the range 30 m to 35 m, actuators are used having a length of 10 m to 24 m with a stroke of 5 m to 10 m.

The number of actuators depends on the force of the actuators. Still more particularly, the actuators deliver a force in the range 150 metric tonnes (T) to 750 T, preferably in the range 250 T to 500 T. It is thus possible to use three or four actuators with force in the range 250 T to 500 T, the rods of the actuators being suitable for moving over a stroke of 5 m to 10 m, in particular for mooring two vessels having a length of 150 m to 300 m.

Still more particularly, said floating and docking structure comprises at least one attachment element suitable for attaching to the second vessel while said float is ballasted at least in part and said attachment element is underwater, said attachment element presenting an arrangement and/or shape making it suitable for being positioned under the bottom of the second vessel by ballasting said docking float and then for pressing against and/or facing the bottom of the second vessel by partially de-ballasting said docking float.

Still more particularly, said attachment element suitable for being underwater is situated on said floating and docking structure at a height such that when the float is de-ballasted and said actuators are safely positioned against the first vessel, said attachment element is out of the water.

In addition and/or as an alternative to attachment in this way to the second vessel, said attachment element may include conventional mooring means using hawsers and fender cylinders for pressing against the side of the second ship or more preferably suction cups or magnetic or pneumatic suction cups for pressing against the side and/or the bottom of the second vessel.

More particularly, said attachment element is constituted or supported by a portion of the floating and docking structure that forms a fork suitable for extending under the bottom of the hull of the second vessel from side to side and supporting magnetic or pneumatic suction cups suitable for bearing against the bilges of the hull of the second vessel.

The vertical force that presses this fork under the vessel is obtained by de-ballasting a said float. Fastening actuation of the suction cups serves to ensure that the second vessel does not slide relative to the coupling device.

Still more particularly, the device of the invention has a single said floating and docking structure constituted by beams and/or tubes assembled together in a truss assembly forming a tower, preferably a tubular structure of rectangular parallelepiped shape, having at least one said float underwater suitable for being ballasted, preferably in the form of a cylinder and/or a rectangular caisson that is integrated in or supported by said structure.

This embodiment facilitates putting the docking device against the second ship or floating support in terms of the stability of the structure in the vertical position by ballasting the float and in terms of its orientation for performing said docking.

Still more particularly, said floating and docking structure extends over a height from under the hull of said second vessel, preferably at least 50 m under the level of the sea or indeed at least 50 m under the hull, up to at least above the deck of said second vessel, preferably over a height (H1) of 60 m to 100 m.

Still more particularly, said floating and docking structure extends in the longitudinal direction of the second vessel over a length of at least one-fourth of the length of said second vessel.

More particularly, said floating and docking structure extends in the longitudinal direction of the second vessel over a length (L1) in the range 40 m to 100 m for a vessel having a length of 150 m to 300 m.

The present invention also provides an assembly of two vessels coupled together remotely side by side using a coupling device of the invention.

Still more particularly, the device of the invention provides coupling between a first vessel, which is a floating support of the type including an installation for liquefying or regassifying gas, and a second vessel of the methane tanker type, with said floating and docking structure supporting troughs for flexible pipes extending out of the water between said first and second vessels arranged side by side.

The present invention also provides a method of implementing a coupling device according to the invention, characterized in that the following steps are performed:

a) with said actuators being in a retracted position and said floating and docking structure with at least one said de-ballasted float being fastened to said actuators via said second fastener and hinge devices, and said actuators being pressed at least in part out of the water against and/or above the hull of the first vessel, said float(s) is/are ballasted in order to immerse said floating and docking structure to the appropriate depth for fastening it to the second vessel, and said actuators are pivoted and deployed together in order to fasten said floating and docking structure against the second vessel;

b) with said actuators deployed in an initial coupling position of medium extension and with said floating and docking structure fastened to said actuators via said second fastener and hinge devices and being fastened to said second vessel via said attachment element(s), with a said float being ballasted, said actuators are actuated in extension and/or said actuators are controlled automatically so that said actuators and the two vessels remain in their initial position or return towards the initial position with a distance between the two vessels being controlled in the event that they depart therefrom; and c) with said actuators being deployed in an initial coupling position of medium extension and said floating and docking structure being fastened to said actuators and to said second vessel, and with said float ballasted, said floating and docking structure is separated from said second vessel, and then said actuators are retracted and said float is de-ballasted in order to cause the actuators to pivot and be pressed at least in part out of the water against and/or above the hull of the first vessel.

BRIEF DESCRIPTION OF THE DRAWINGS

Other characteristics and advantages of the present invention appear better on reading the following description made in illustrative and non-limiting manner, with reference to the accompanying drawings, in which.

DETAILED DESCRIPTION OF VARIOUS EMBODIMENTS

Figure 1A:
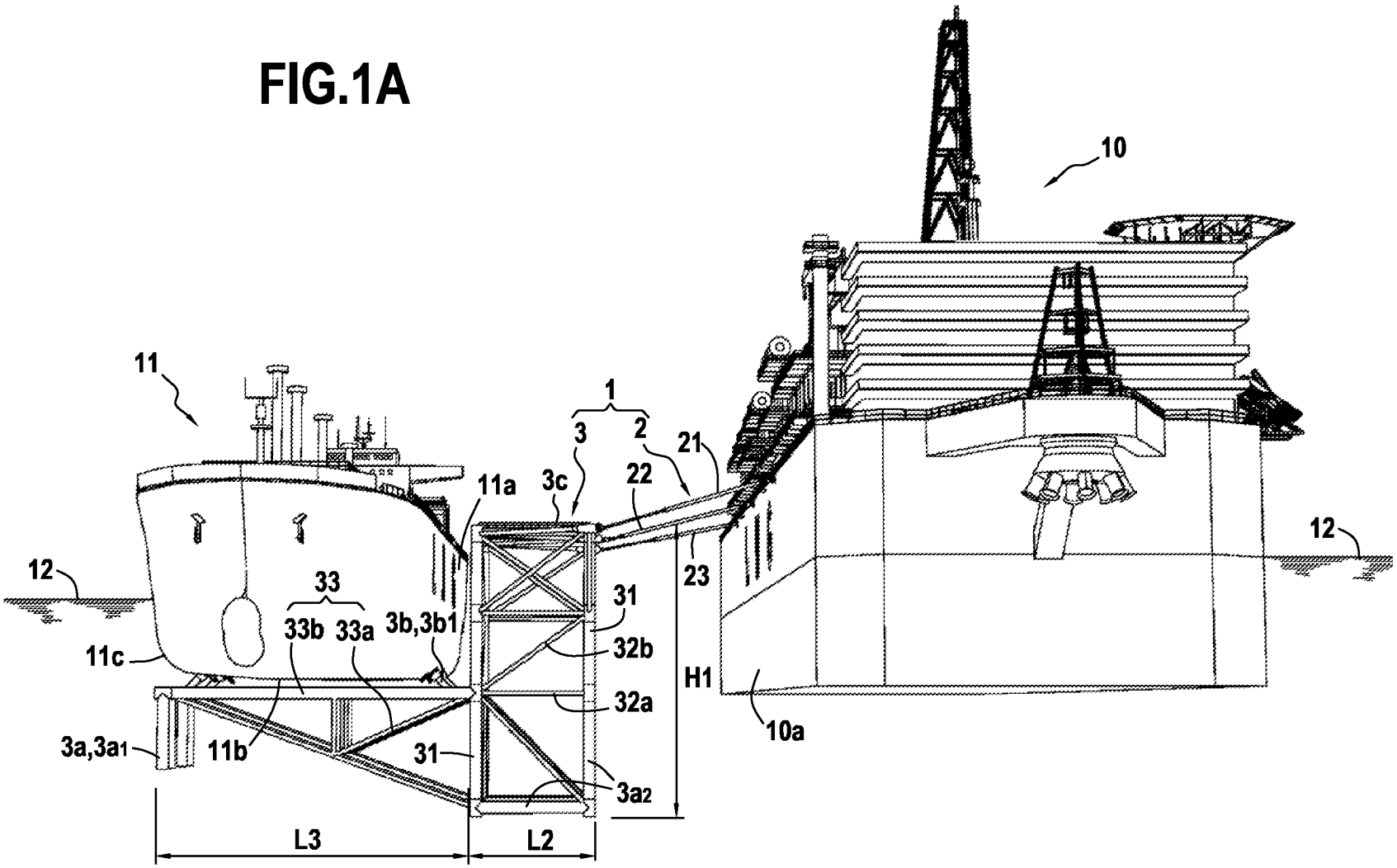
FIGS. 1A and 1B are views of a first preferred embodiment of the device 1 of the invention in the coupling position, fixed to and between the first vessel of the FLNG type and the second vessel of the LNGC type (FIG. 1A), and also in the absence of the second vessel (FIG. 1B)
Figure 1B:
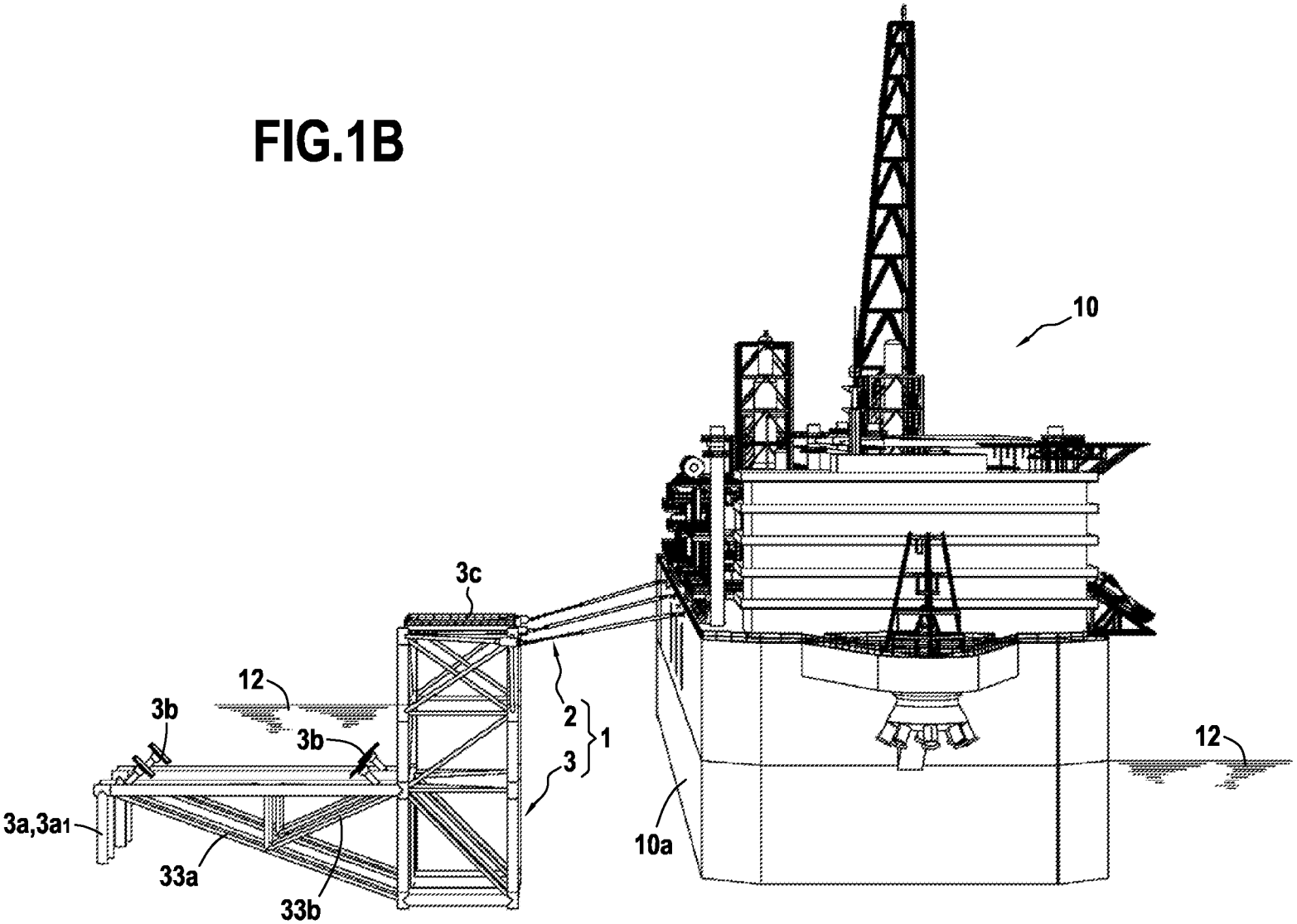
Figure 2A:
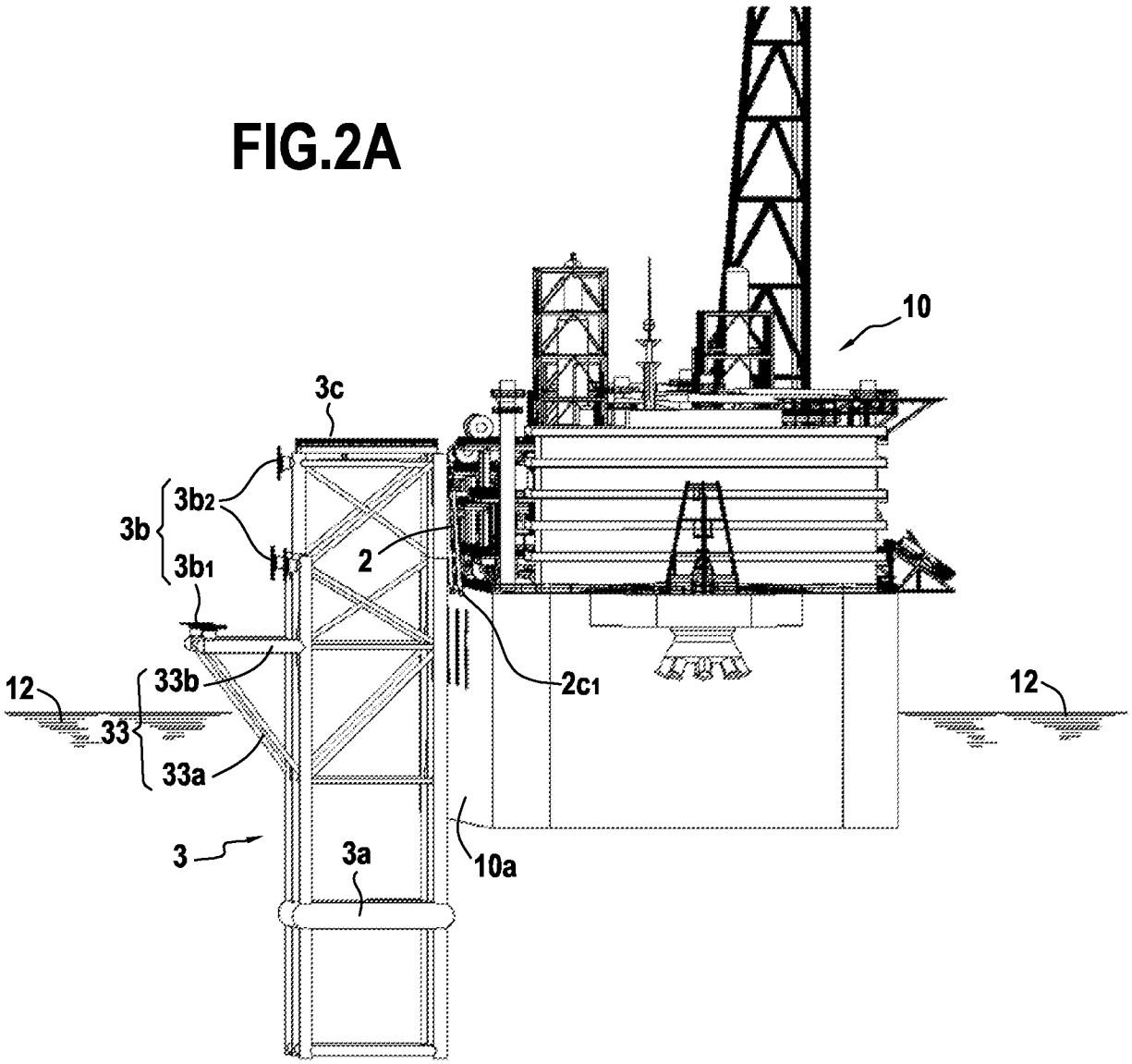
FIGS. 2A and 2B are views of a second embodiment of the device 1 of the invention in a stowed position fixed against the hull of a first vessel of the FLNG type (FIG. 2A), and in the coupling position between two vessels (FIG. 2B)
Figure 2B:
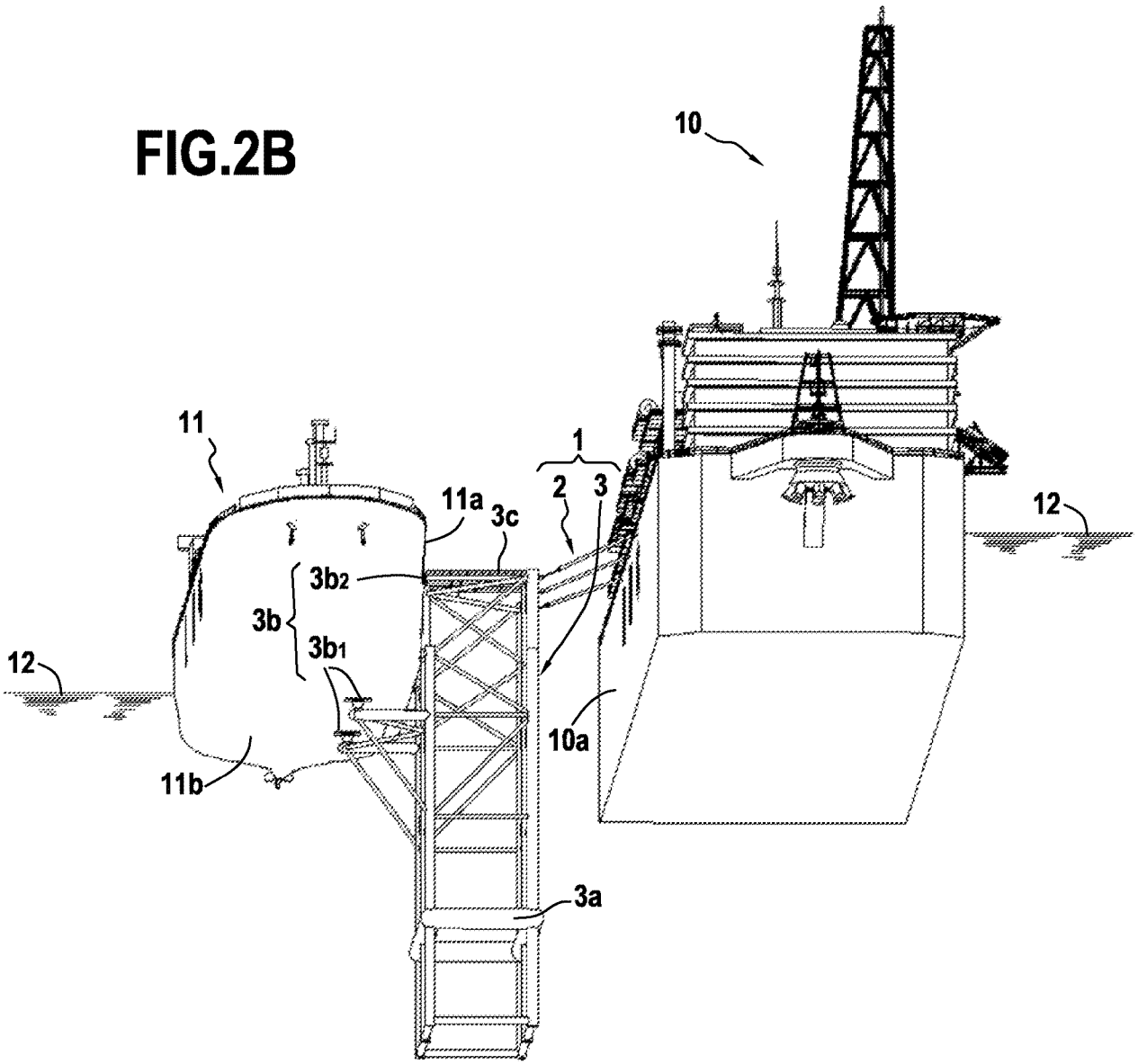
Figure 3A:
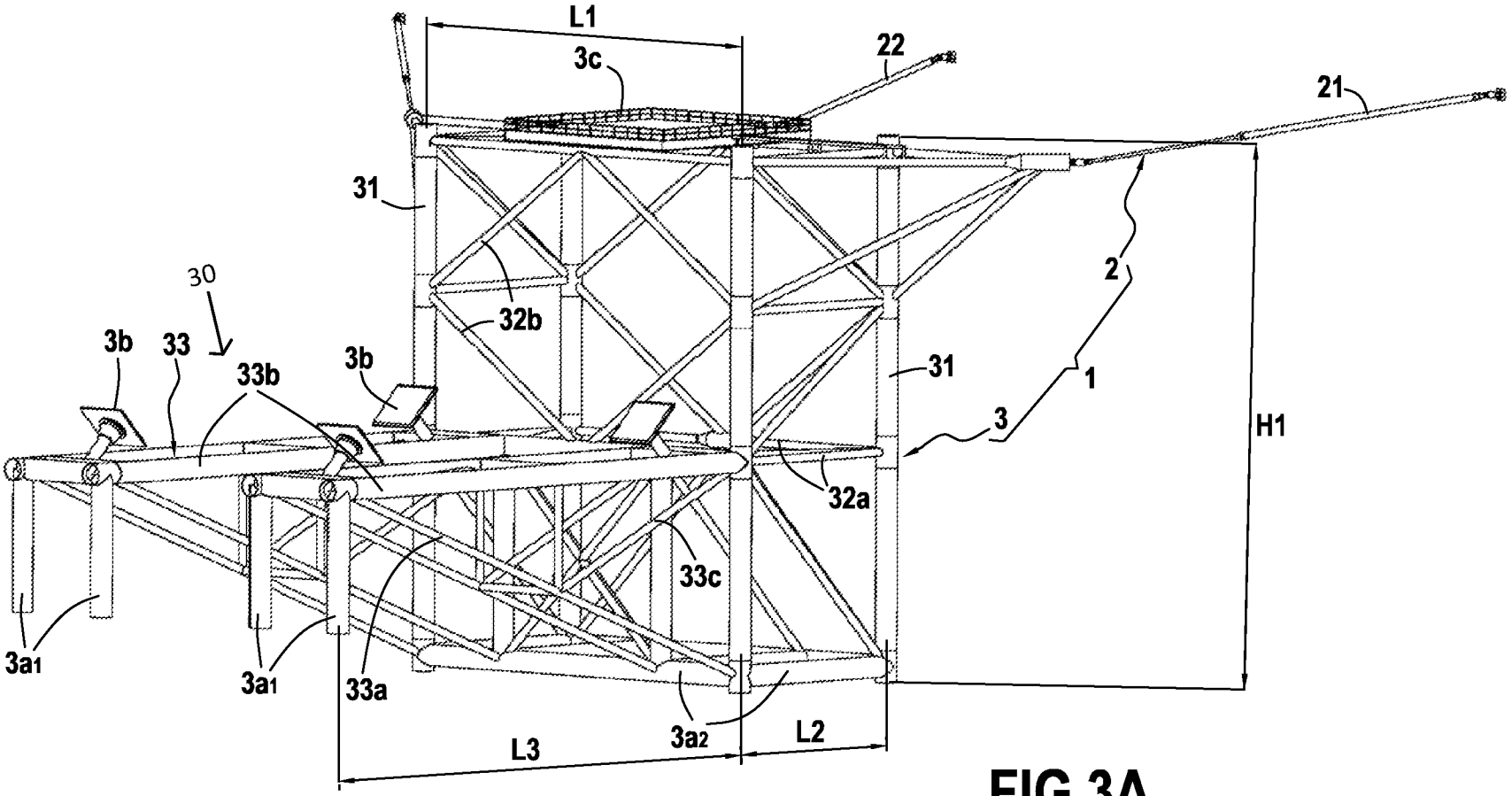
FIGS. 3A to 3C show the floating and docking structures 3 in the first, second, and third embodiments (FIGS. 3A, 3B, and 3C) of the coupling device of the invention.
Figure 3B:
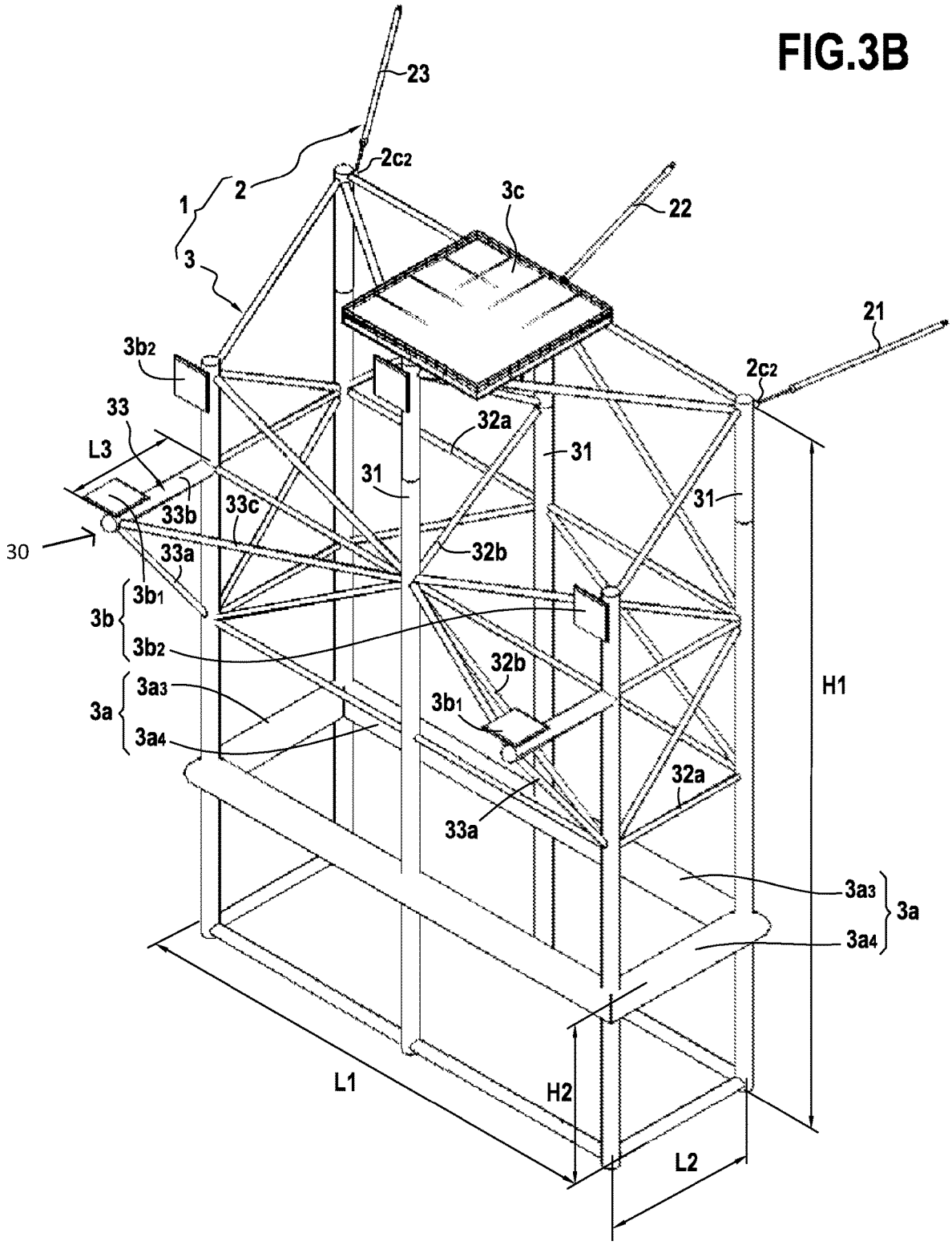
Figure 3C:
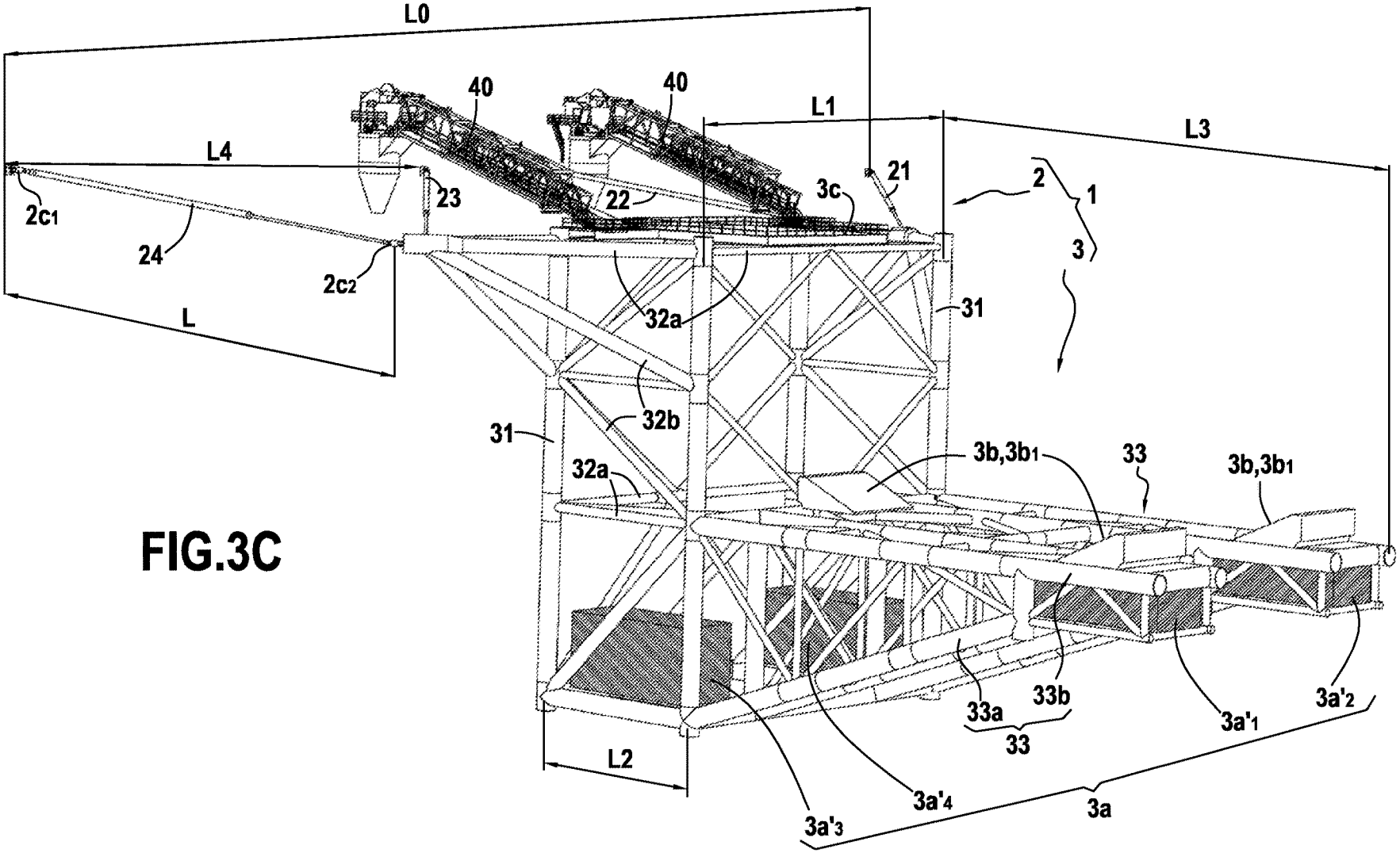

In FIGS. 1A-1B, 2A-2B, and 3A-3C, the floating and docking structure 3 comprises an open structure forming a tower made by assembling together a plurality of vertical tubes 31 arranged so as to form at least the four edges of said tower and so as to support a top platform 3*c*. The tower is connected to the first vessel 10 by actuators 21-24 as described below. Each vertical tube 31 is assembled to each of the other two adjacent tubes 31 that are the closest, a) by first horizontal junction beams or tubes 32*a* perpendicular to the axis of the tower, and b) by second junction beams or tubes 32*b* arranged to slope in chevrons or on diagonals, possibly crossing one another between two of said vertical tubes 31. On its top face, the tower supports a platform 3*c* suitable for receiving a technical intervention crew that may access it, by way of example, from the first vessel 10 via gangways 40 as shown in FIG. 3C.

The tower is fitted with the mooring system 3*b*, 3*b*1 3*b*2 forming a said attachment element 3*b*, 3*b*1, 3*b*2 for attaching said floating and docking structure to the hull of the second vessel 11. Said attachment element or mooring system 3*b*, 3*b*1, 3*b*2 may comprise a system of plates 3*b*1, 3*b*2 having suction cups or magnetic fasteners 3*b*, the system of plates having suction cups or magnetic fasteners 3*b* defining the attachment element 3*b*, 3*b*1, 3*b*2.

In the first preferred embodiment of FIG. 3A, the attachment element 3*b*, 3*b*1, 3*b*2 comprises four of said plates 3*b* fitted with suction cups or magnetic fasteners arranged on the top faces of two pairs of cantilevered-out horizontal tubular elements 33*b* constituting a fork 33 that extends horizontally forward outside the tower towards the second vessel from the face of the tower facing the vessel. These horizontal tubular elements 33*b* are supported by sloping lower tubular elements 33*a* forming a fork 33 extending in the horizontal direction over a length L3 covering the width of the hull 11*b* of the second vessel and supporting four plates which may merely be supports and/or which may be magnetic fasteners, such as magnetic suction cups 3*b*. In FIG. 3A, these plates 3*b* slope so as to bear against the bilges 11*c* on either side of the hull (junction zone between the side 11*a* and the keel 11*b*), or two pairs of plates 3*b* sloping systematically in opposite directions on either side. In this example, the width L3 is about 50 m, which is representative of the largest methane tankers and makes it possible to receive 30 m wide methane tankers. The offset longitudinal end of said fork is supported by floats 3*a* in the form of vertical cylinders 3*a*1 suitable for being ballasted and/or de-ballasted. Other lower tubular portions 3*a*2 of the tower constitute floats in the form of cylinders suitable for being ballasted and/or de-ballasted.

The floating and docking structure 3 shown in FIG. 3A is an open structure constituted by tubular elements that are assembled together in a truss assembly forming a tower of rectangular parallelepiped shape having a height H1=89.5 m, a length L1=60 m in the longitudinal direction of the two vessels, and a width L2=20 m in the direction perpendicular to said longitudinal direction for mooring together two vessels that are 150 m to 300 m long.

In the second preferred embodiment of FIG. 3B, said docking element 30 comprises a pair of cantilevered-out horizontal tubular elements 33*b* forming a fork 33 extending horizontally forwards over a shorter length L3=15 m. In the bottom portion of the tower of FIG. 3B, at about H2=20 m from its bottom end, the tower supports or incorporates floats 3*a* in the form of cylinders 3*a*3 and 3*a*4 having a diameter in the range 2 m to 3 m and respectively of length L2=20 m for 3*a*4 and L1=60 m for 3*a*3, which cylinders are arranged horizontal forming a rectangular belt connecting together the vertical tubes 31 at the edges of the rectangular parallelepiped having the same height H1 of 89.5 m.

In FIG. 3C, in a third embodiment, the floating structure 3 comprises a tower supporting floats 3*a* comprising four buoyancy caissons 3*a*'1-3*a*'4 of rectangular parallelepiped shape, of which two 3*a*'3 and 3*a*'4 are in the bottom portion of the tower, and two 3*a*'1 and 3*a*'2 are under the forward end of the fork 33. The fork 33 supports three plates 3*b* arranged in a triangle, with one plate being beside the tower and two plates sloping in the opposite direction being beside the ends of the two branches of the fork. The distribution of thrust between the cylindrical members 31, 32*a*-32*b*, 33*a*-33*b* of the tower and these four caissons 3*a*'1-3*a*'4 is 2600 metric tonnes force for the cylindrical members compared with 1700 metric tonnes force for the four caissons 3*a*'1-3*a*'4. In FIG. 3C, the dimensions of the floating structure 3 and of the fork 33 are L1=40 m, L2=20 m, and L3=55 m.

In FIGS. 2A-2B and 3B, the support plates or magnetic suction cups 3*b* comprise three vertical plates 3*b*2 on the outside face of the tower and two horizontal plates 3*b*1 on the top face at the end of the fork 33 that become pressed against the side 11*a* and the bottom 11*b* respectively of the second vessel 11. More precisely, in this embodiment, on a face that faces the second vessel, the tower supports:

- three magnetic or pneumatic suction cups 3*b* or plates 3*b*2 in the top portion of the tower, arranged in a triangle forming vertical top plates 3*b*2 suitable for pressing against and fastening to the flank of the second vessel at the top portion of the tower; and
- two magnetic or pneumatic suction cups 3*b* or plates 3*b*1 forming horizontal bottom plates 3*b*1 supported by said fork and suitable for bearing against and fastening to the underside of the hull of the second vessel.

In all three embodiments, the cantilevered-out tubular elements 33*b* are themselves supported by junction tubular elements 33*a* that serve to connect them with the tower, and said fork 33 may bear against and be fastened to the underside of the hull 11*b*-11*c* of the second vessel 11.

The coupling device 1 shown in FIGS. 1A-1B, 2A-2B, and 3B has three actuators 21, 22, and 23, two actuators 21-22 in FIG. 3A, and four actuators 21-24 in FIG. 3C. The actuators 21-24 are single-chamber or telescopic actuators and they are double-acting. The various actuators are spaced apart successively from one another in the longitudinal direction of the first vessel 10 and of the tower 3. At one end, each actuator is fastened to a high portion above the water of the tower of the floating structure 3, and at its other end it is fastened to or for fastening to a high portion above the water of the hull 10*a* of the first vessel 10 so as to be capable, in the deployed position, of extending over the surface of the water 12.

More precisely, for each actuator, rear end plates of the actuator cylinder 2*a* are fastened via a hinge device 2*c*1 to the hull 10*a* of the first vessel 10, and the end of the actuator rod 2*b* is fastened via a hinge device 2*c*2 at the top portion of a floating and docking structure 3 that enables the device to float and that enables the vertical position of the assembly to be adjusted.

Figure 4:
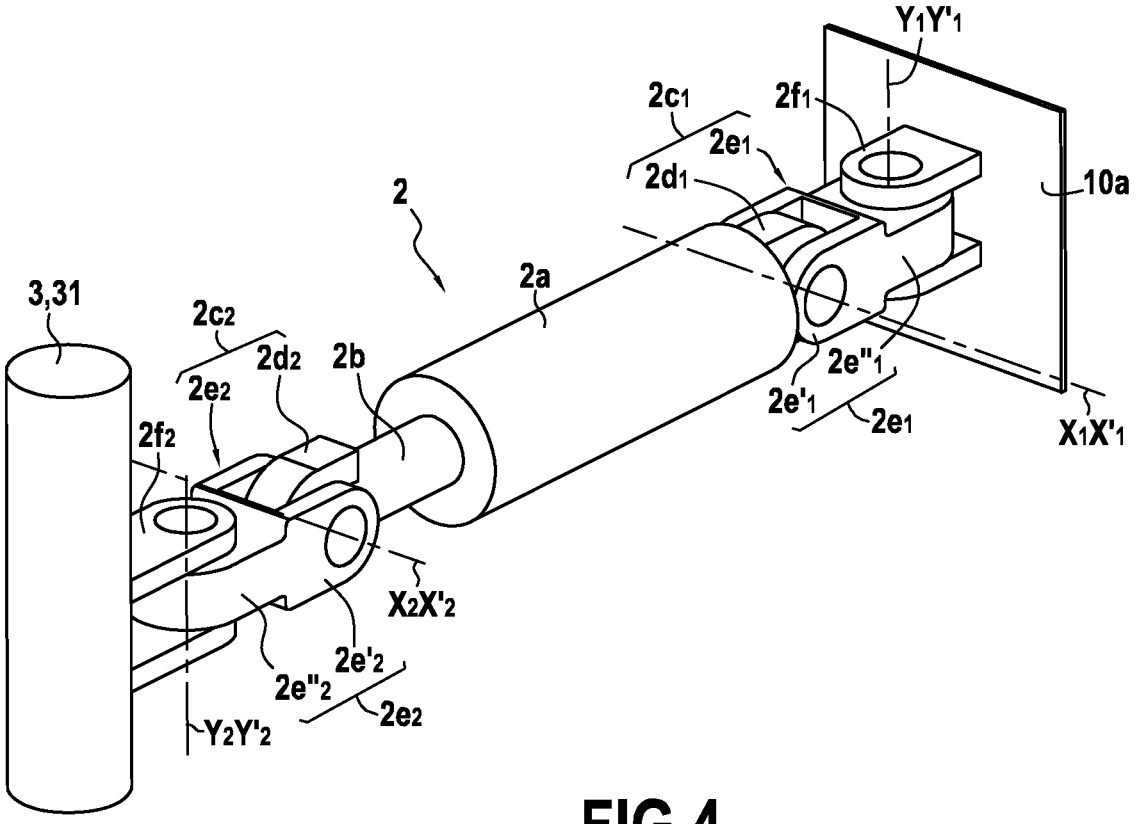
FIG. 4 is a detail view of an actuator 2, 21-24 with its two fastener and pivot hinge devices, 2*c*1 for connection to the first vessel 10 of the FLNG type, and 2*c*2 for connection to a tubular element 31 of the tower of the floating and docking structure 3.

The fastener and hinge devices 2*c*1 and 2*c*2 shown in FIG. 4 provide two degrees of freedom to move in pivoting about two perpendicular pivot axes comprising a system allowing a first pivoting of said actuator about a horizontal first pivot axis perpendicular to the longitudinal axis of the actuator, namely X1X1' for 2*c*1 and X2X2' for 2*c*2, and second pivoting of said actuator about a second pivot axis namely Y1Y1' for 2*c*1 and Y2Y2' for 2*c*2, that is perpendicular to the longitudinal axis of the actuator situated in a vertical plane containing the longitudinal axis of the actuator.

Each of the fastener and hinge devices 2c1 and 2c2 comprises an intermediate independent connection part 2e1, 2e2, each comprising:

a first portion comprising two branches forming a first clevis 2e'1, 2e'2 co-operating with a first fastener plate 2d1 secured to the end of the actuator cylinder 2a for 2c1 and to a second fastener plate 2d2 secured to the end of the actuator rod 2b for 2c2; and a second portion forming a third fastener plate 2e"1, 2e"2 co-operating with two branches forming a second clevis 2f1 secured to the vessel 10 for 2c1 and respectively a third clevis 2f2 secured to a tube 31 of the structure 3 for 2c2.

For each fastener and hinge device 2c1, 2c2, the first pivot axis X1X1' and X2X2' passes through orifices in the two branches of the first clevis 2e'1, 2e'2 and an orifice in said first or second fastener plate 2d1 or 2d2 respectively arranged between the two branches of the first clevis so that said first or second fastener plate 2d1, 2d2 is suitable for pivoting about the horizontal first axis X1X1' or X2X2' relative to said intermediate independent connection parts 2e1, 2e2; and said second axis Y1Y1', Y2Y2' passes through orifices in the two branches of the second clevis 2f1 or respectively the third clevis 2f2 and passes through an orifice in said third fastener plate 2e"1, 2e"2 arranged between the two branches of the second and third devises in such a manner that said third fastener plate is suitable for pivoting about the second axis Y1Y1', Y2Y2' relative to said intermediate independent connection part 2e1, 2e2.

Preferably, the actuator rod 2a is also suitable for turning about its own axis in the actuator cylinder 2b, so that the actuator thus forms a swivel connected to the two devices 2c1 and 2c2 and allowing a third pivoting movement about the longitudinal direction of the actuator.

Alternatively, use is made of a pivot fastener and hinge device of the ball joint type. The ball joints used for said first and second pivot fastener and hinge devices are typically mechanical elements having a ball embedded in a spherical housing, thus enabling the actuators to work only axially in sliding.

The coupling device 1 is typically secured to the first vessel 10 of the FLNG type using the actuators while in the retracted position, each having one end 2c1 fastened to the flank or side 10a of the first vessel.

When the coupling device 1 is not in use, in particular in a storm, it is put into a safe or stowed position: the actuators 2, 21-24 are retracted and positioned so as to be folded upwards above their ends 2c1 against the hull of the first vessel, with the floating and docking structure 3 put in a high position by at least partially de-ballasting said float(s) 3a so as to be capable of following the actuators and allowing them to pivot until the maximally retracted actuators are in a substantially vertical position with said floating and docking structure 3 fastened to said actuators via said second fastener and hinge devices 2c2, the assembly of the actuators and the floating structure 3 being pressed, while at least in part out of the water, against the hull of the first vessel, as shown in FIGS. 1A-1B and 2B. The floating and docking structure 3 is attached to the second vessel, typically an LNGC (LNG carrier) by performing the following successive steps:

with the set of actuators 2, 21-24 and the floating structure 3 pressed at least in part out of the water against the hull of the first vessel, as shown in FIGS. 1A-1B and 2B, said float(s) is/are ballasted in order to immerse said floating and docking structure 3 to the appropriate depth, and simultaneously said actuators are pivoted and deployed by hydraulic actuation to a sloping position above the surface of the water 12, preferably sloping at an angle of less than 15° relative of the horizontal;

thereafter, the assembly comprising the first vessel and said coupling device that is fastened thereto is moved towards the second vessel, or preferably given that the first vessel is generally anchored, it is the second vessel that is moved by tug into the proximity of the first vessel and of said coupling device that is fastened thereto; then once facing the second vessel, the floats 3a1-3a4, 3a'1-3a'4 are ballasted to lower the plates 3b facing the hull, in particular the bottom plates 3b, 3b1 on the top face of the fork 33 under the hull 11b, 11c of the second vessel 11; then the floats 3a1-3a4, 3a'1-3a'4 are de-ballasted again so that the bottom plates 3b, 3b1 rise and come to press against and/or face the bottom of the hull 11a of the second vessel 11; and said plates are actuated to become fastened against the hull of the second vessel, in particular by using the magnetic fastener suction cups they include (3b, 3b1-3b2).

In FIGS. 3A and 3B, the coupling device 1 has three actuators 21-23, comprising a central actuator 22 and two actuators 21 and 23 suitable for being arranged symmetrically relative to the central actuator. Thus, when the actuators are deployed and fastened to the floating structure 3, the central actuator 22 lies in a vertical plane perpendicular to the vertical plane that is tangential to the side 10 of the first vessel 10, while the actuators 21 and 23 are arranged symmetrically in vertical planes that slope at an angle of less than 30° relative to a vertical plane perpendicular to the vertical plane that is tangential to the side of the first vessel 10.

In FIG. 3C, the four actuators 21-24 are arranged as two pairs of actuators 21-22 and 23-24 each forming a V-shape when they are deployed and fastened to the floating structure 3. The distance between the tip 2c2 of the actuator 24 and the corresponding tip of the actuator 21 on the coupling device is about 80 m. The distance between the tip 2c1 of the actuator 24 and the corresponding tip of the actuator 21 on the side of the first vessel is L0=140 m. The spacings L4=60 m of the two actuators in each pair 24-23 and 22-21 are greater beside their fastenings 2c1 to the hull of the first vessel than the spacings of their fastenings 2c2 on the floating structure 3, which are close to one another. The various actuators 21-24 are arranged in a vertical plane sloping at an angle of less than 30 degrees relative to a vertical plane perpendicular to the vertical plane that is tangential to the side of the first vessel.

In all of the embodiments, the actuators are also arranged to slope relative to a horizontal plane at an angle of less than 15 degrees.

In its top portion, said floating and docking structure 3 may advantageously support troughs for supporting flexible pipes extending out of the water between said first and second vessels arranged side by side.

It is possible to use four actuators 21-24 each having a rating of 250 metric tonnes (T), the actuator rods being suitable for moving over a stroke of 5 m to 10 m, in particular for docking together two vessels that are 150 m to 300 m long.

More particularly, an actuator stroke of 5 m with actuator lengths in the range 10 m to 15 m enables the vessels to be spaced apart by 30 m to 34 m, or indeed a stroke of 10 m leads to actuator lengths in the range 22 m to 24 m for spacing between the vessels of 40 m to 44 m.

Once the coupling device 1 is attached to the second vessel 11, it is capable of keeping the two vessels at a constant mean distance apart in spite of weather environments, either passively or else by appropriate hydraulic control.

With said actuators initially deployed in a medium extension position when coupling said floating and docking structure that is fastened to said actuators with said second vessel, and with a said float that is ballasted, as shown in FIG. 2A, the extension of said actuators is operated and/or automatically controlled so that said actuators and the two vessels remain in their initial position or return towards their initial position with a distance between the two vessels that is controlled in the event of them moving apart.

Because of the long stroke of the actuators, the two vessels interact dynamically with each other relatively little. The forces taken up by the device are forces that are averaged and not impact forces. Because of this feature, it is possible to keep the vessels together even when the swell becomes strong (swells of about 4 m can typically be withstood).

In order to optimize the position of the ships and the forces in the device, the actuators may be controlled in three ways:

linear passive control: the actuators behave like springs of linear response regardless of the position of the rods within the cylinders;

non-linear passive control: the actuators behave like springs with stiffness that depends on the position of each rod within the cylinder of the actuator; and non-linear active control: the stiffness of the actuators is adapted instantaneously under the control of software analyzing the relative position of the two vessels. With said actuators 21, 22, 23 being initially deployed in a medium extension position for coupling purposes and with said floating and docking structure 3 fastened to said actuators and to said second vessel, and with said docking float 3*a* ballasted, said floating and docking structure 3 is separated from said second ship, and then said actuators are retraced and said docking float 3*a* is de-ballasted so as to press the assembly while at least partially out of the water against the hull of the first vessel as described above.

The invention claimed is:

1. A device for remotely coupling together a first vessel consisting of a first ship or floating support and a second vessel consisting of a second ship, the device for remotely coupling together the first and second vessels comprising:

at least one floating and docking structure comprising at least one docking float suitable for being ballasted and de-ballasted in order to enable the at least one floating and docking structure to be immersed, and at least one docking element fastened to or suitable for being releasably fastened to a hull of the second vessel; and at least two actuators spaced in succession from one another in a longitudinal direction of the first vessel, one end of an actuator cylinder of each of the at least two actuators being fastened to the first vessel using respective first fastener and pivot hinge devices, wherein an end of a rod of each of the at least two actuators is configured for being fastened to the at least one floating and docking structure via respective second fastener and pivot hinge devices.

2. The device for remotely coupling together a first vessel consisting of a first ship or floating support and a second vessel consisting of a second ship according to claim 1, wherein the at least two actuators, in a retracted position and fastened to the at least one floating and docking structure via said second fastener and pivot hinge devices, are suitable for being positioned together, vertically or in a position close to a vertical axis, against a hull of the first vessel and out of water when the at least one floating and docking structure is not fastened to the second vessel and when the at least one docking float is de-ballasted.

3. The device for remotely coupling together a first vessel consisting of a first ship or floating support and a second vessel consisting of a second ship according to claim 1, wherein the respective first and second fastener and pivot hinge devices at the end each of the at least two actuators each make possible at least a first pivoting movement of each of the at least two actuators about a horizontal first axis perpendicular to a longitudinal axis of a corresponding actuator of the at least two actuators, and wherein the respective first and second fastener and pivot hinge devices at the ends of each of the at least two actuators also each make possible a second pivoting movement of each of the at least two actuators about a second axis perpendicular to the longitudinal axis of the corresponding actuator of the at least two actuators and situated in a vertical plane containing the longitudinal axis of each of the at least two actuators, and wherein the respective first and second fastener and pivot hinge devices at the ends of each of the at least two actuators also make possible a third pivoting movement about the longitudinal axis of the corresponding actuator of the at least two actuators.

4. The device for remotely coupling together a first vessel consisting of a first ship or floating support and a second vessel consisting of a second ship according to claim 1, wherein when the rod of each of the at least two actuators is fastened to the at least one floating and docking structure, each of the at least two actuators is arranged above a surface of water horizontally or with the rod sloping relative to a horizontal plane at an angle of less than 15 degrees while remaining out of the water, the actuator cylinder of each of the at least two actuators being fastened to a side of a hull of said first vessel at a same height.

5. The device for remotely coupling together a first vessel consisting of a first ship or floating support and a second vessel consisting of a second ship according to claim 1, wherein when the at least two actuators are fastened to the at least one floating and docking structure, the at least two actuators are arranged parallel to one another and/or sloping at an angle of less than 30 degrees relative to a first vertical plane perpendicular to a second vertical plane that is tangential to a side of the first vessel.

6. The device for remotely coupling together a first vessel consisting of a first ship or floating support and a second vessel consisting of a second ship according to claim 1, wherein the at least two actuators are double-acting hydraulic actuators having the rods, the rods being set to an initial coupling extension position defining a first distance between the first and second vessels and having a hydraulic circuit that is adjusted and/or automatically controlled in such a manner that any departure from the first distance to a second distance is corrected in order to reestablish the first distance between the first and second vessels, and to reestablish the initial coupling extension position of the rods.

7. The device for remotely coupling together a first vessel consisting of a first ship or floating support and a second vessel consisting of a second ship according to claim 1, wherein the at least one floating and docking structure comprises at least one attachment element suitable for attaching to the second vessel while the at least one docking float is ballasted at least in part and the at least one attachment element is underwater, and wherein the at least one attachment element presenting an arrangement and/or shape making the at least one attachment element suitable for being positioned under a bottom of a hull of the second vessel by ballasting the at least one docking float and then for pressing against and/or facing the bottom of the hull of the second vessel by partially de-ballasting the at least one docking float.

8. The device for remotely coupling together a first vessel consisting of a first ship or floating support and a second vessel consisting of a second ship according to claim 7, wherein the at least one attachment element is suitable for being underwater is situated on the at least one floating and docking structure at a height such that when the at least one docking float is de-ballasted and said actuators are safely positioned against the first vessel, the at least one attachment element is out of water.

9. The device for remotely coupling together a first vessel consisting of a first ship or floating support and a second vessel consisting of a second ship according to claim 7, wherein the at least one attachment element of the at least one floating and docking structure suitable for attaching to the second vessel includes magnetic or pneumatic suction cups suitable for pressing against a side and/or the bottom of the hull of the second vessel.

10. The device for remotely coupling together a first vessel consisting of a first ship or floating support and a second vessel consisting of a second ship according to claim 7, wherein the at least one attachment element is constituted or supported by a portion of the at least one floating and docking structure that forms a fork suitable for extending under the bottom of the hull of the second vessel from a first side to a second side and supporting magnetic or pneumatic suction cups suitable for bearing against bilges of the hull of the second vessel.

11. The device for remotely coupling together a first vessel consisting of a first ship or floating support and a second vessel consisting of a second ship according to claim 1, wherein the at least one floating and docking structure comprises a single floating and docking structure constituted by beams and/or tubes assembled together in a truss assembly forming a tower having the at least one docking float underwater and suitable for being ballasted.

12. The device for remotely coupling together a first vessel consisting of a first ship or floating support and a second vessel consisting of a second ship according to claim 11, wherein the tower has a tubular structure of a rectangular parallelepiped shape.

13. The device for remotely coupling together a first vessel consisting of a first ship or floating support and a second vessel consisting of a second ship according to claim 11, wherein the at least one docking float suitable for being ballasted is in the form of a cylinder and/or a rectangular caisson that is integrated in or supported by the single floating and docking structure.

14. The device for remotely coupling together a first vessel consisting of a first ship or floating support and a second vessel consisting of a second ship according to claim 1, wherein the at least one floating and docking structure extends:

a) heightwise from under a hull of the second vessel to at least above a deck of the second vessel; and b) in a longitudinal direction of the second vessel over a length that is at least one-fourth of a length of said second vessel.

15. An assembly of two vessels remotely coupled together using a device for remotely coupling together a first vessel consisting of a first ship or floating support and a second vessel consisting of a second ship according to claim 1.

16. The assembly of two vessels according to claim 15, wherein the device for remotely coupling together a first vessel consisting of a first ship or floating support and a second vessel consisting of a second ship provides coupling between the first vessel which is a floating support including an installation for liquefying or regassifying gas, and the second vessel comprising a methane tanker.

17. A method of implementing a device for remotely coupling together a first vessel consisting of a first ship or floating support and a second vessel consisting of a second ship according to claim 1, wherein the following steps are performed:

with the at least two actuators being in a retracted position and the at least one floating and docking structure with the at least one docking float being de-ballasted and fastened to the at least two actuators via the respective second fastener and pivot hinge devices, and the at least two actuators being pressed at least in part out of water against and/or above a hull of the first vessel, ballasting the at least one docking float in order to immerse the at least one floating and docking structure to a depth for fastening the at least one floating and docking structure to the second vessel, pivoting and deploying the at least two actuators together in order to fasten the at least one floating and docking structure against the second vessel;

with the at least two actuators deployed in an initial coupling position with the at least one floating and docking structure fastened to the at least two actuators via the respective second fastener and pivot hinge devices and being fastened to the second vessel via a respective at least one attachment element, with said at least one docking float being ballasted, actuating the at least two actuators in extension and/or controlling automatically the at least two actuators such that the at least two actuators and the first and second vessels remain in the initial coupling position or return towards the initial coupling position with a distance between the first and second vessels being controlled in the event that the at least two actuators and the first and second vessels depart therefrom;

with the at least two actuators being deployed in the initial coupling position and the at least one floating and docking structure being fastened to the at least two actuators and to said second vessel, and with the at least one docking float ballasted, separating the at least one floating and docking structure from the second vessel, retracting the at least two actuators, and de-ballasting the at least one docking float in order to cause the at least two actuators to pivot and be pressed at least in part out of the water against and/or above the hull of the first vessel.

* * * * *